US006986620B2

(12) United States Patent
Abbas

(10) Patent No.: US 6,986,620 B2
(45) Date of Patent: Jan. 17, 2006

(54) FLUID APPLICATOR INSTRUMENT

(76) Inventor: Ashraf Mahfouz Abbas, 799 Harrow Road, London (GB) NW10 5PA ( * ) Notice: Subject to any disclaimer, the term of this patent is extended or adjusted under 35 U.S.C. 154(b) by 0 days.

(21) Appl. No.: 10/276,216

(22) PCT Filed: May 9, 2001

(86) PCT No.: PCT/GB01/02031

§ 371 (c)(1),
(2), (4) Date: Nov. 14, 2002

(87) PCT Pub. No.: WO01/87641

PCT Pub. Date: Nov. 22, 2001

(65) Prior Publication Data

US 2003/0123921 A1 Jul. 3, 2003

(30) Foreign Application Priority Data

May 15, 2000 (GB) ..... 0011689
Sep. 20, 2000 (GB) ..... 0023063
Dec. 19, 2000 (GB) ..... 0030949

(51) Int. Cl.
*A46B 11/02* (2006.01)

(52) U.S. Cl. ..... 401/188 A; 401/188 R

(58) Field of Classification Search ..... 401/187–189, 401/198, 199, 205
See application file for complete search history.

(56) References Cited

U.S. PATENT DOCUMENTS 3,420,610 A * 1/1969 Malm ..... 401/112
3,792,932 A * 2/1974 Henriksen ..... 401/148
4,472,462 A * 9/1984 Apice et al. ..... 427/288
4,789,261 A * 12/1988 Iwase et al. ..... 401/190
5,176,461 A * 1/1993 Kimura ..... 401/279
6,224,284 B1 * 5/2001 Sukhna et al. ..... 401/198
6,592,282 B2 * 7/2003 Fontanet et al. ..... 401/266

* cited by examiner

*Primary Examiner*—David J. Walczak
(74) *Attorney, Agent, or Firm*—Sonnenschein, Nath & Rosenthal LLP; Bryan P. Stanley

(57) ABSTRACT

A marking instrument, for applying a fluid to a surface and particularly, though not exclusively, to a writing pen, including a marker pen, or a brush, especially an artist's brush. Other types of brushes are contemplated, such as those for applying cleaner, mouthwash or perfume to teeth. The instrument (2) comprises a tip (6), a holder for the tip (4), a cartridge (14) containing the fluid mounted within or connectable to the holder (4), and a manually-operable spray pump arrangement (10) for repeatedly dispensing a predetermined amount of the fluid under pressure from the cartridge (14) to the tip (4) of the instrument (2). A disposable or re-fillable cartridge for the instrument is also described.

30 Claims, 11 Drawing Sheets

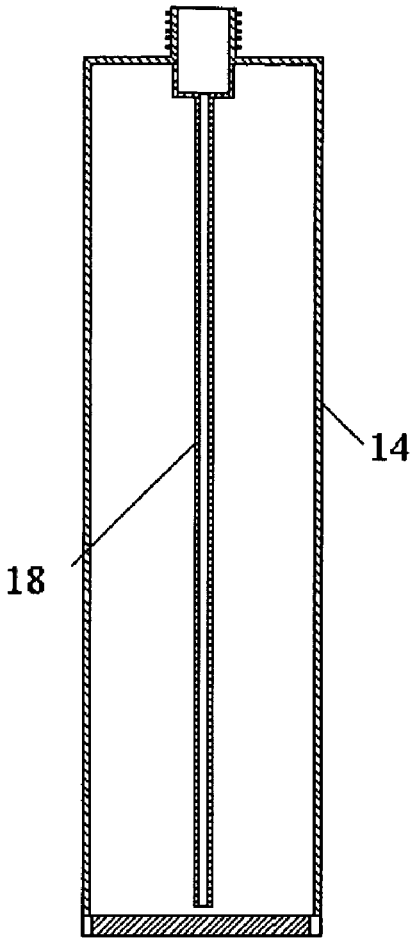
Fig 6
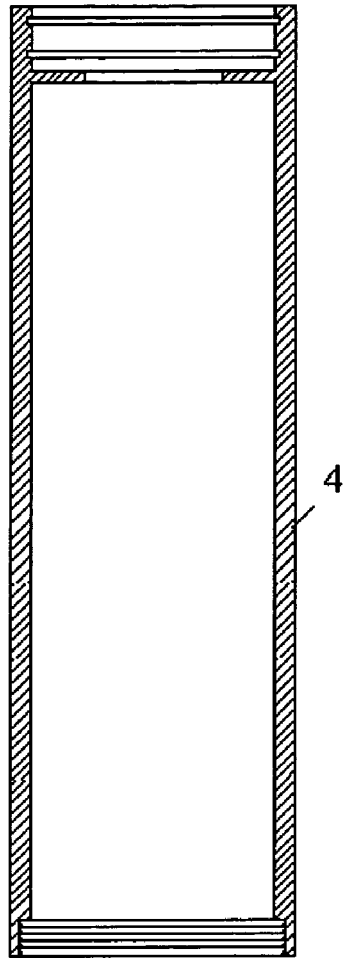
Fig5
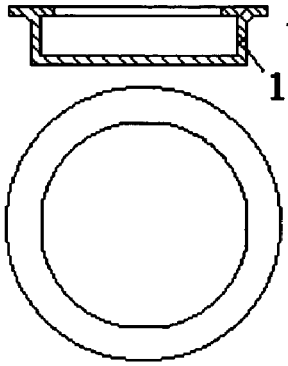
Fig 7a
Fig 7b
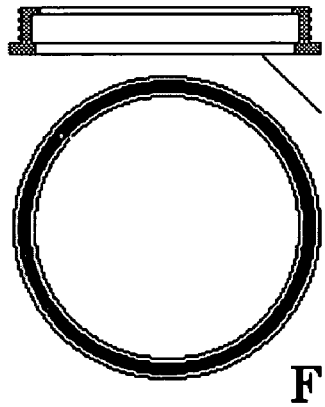
Fig 8a
Fig 8b

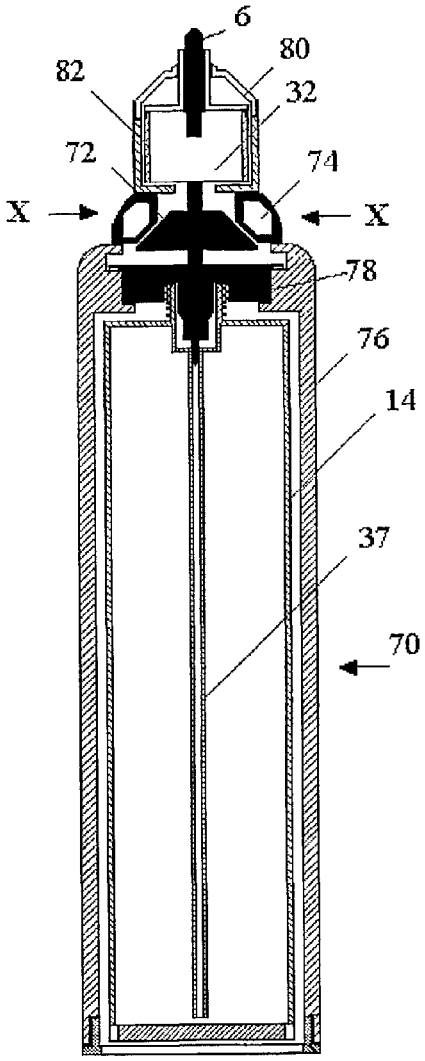
Fig 11
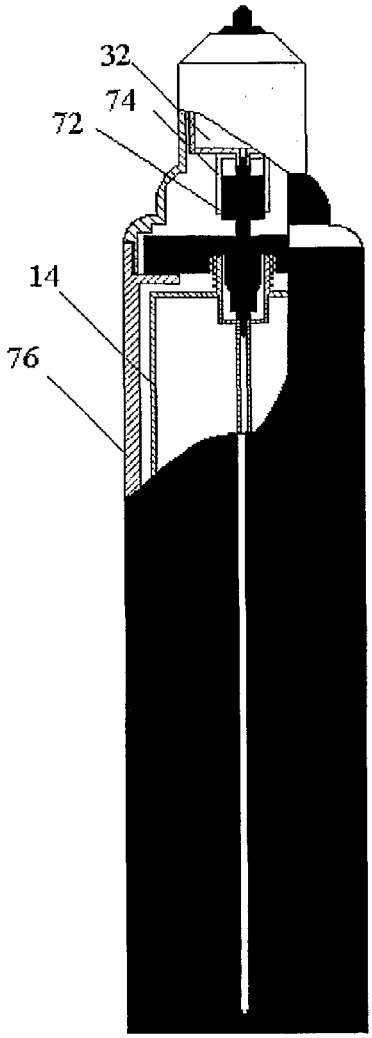
Fig 12
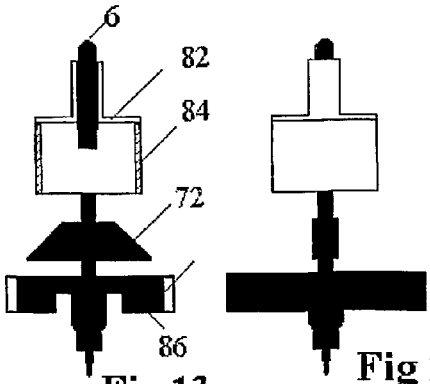
Fig 13
Fig 13a
Fig 14
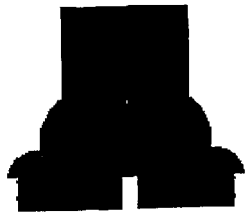
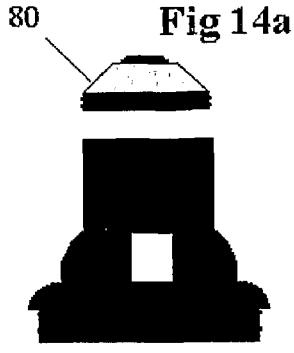
Fig 14a

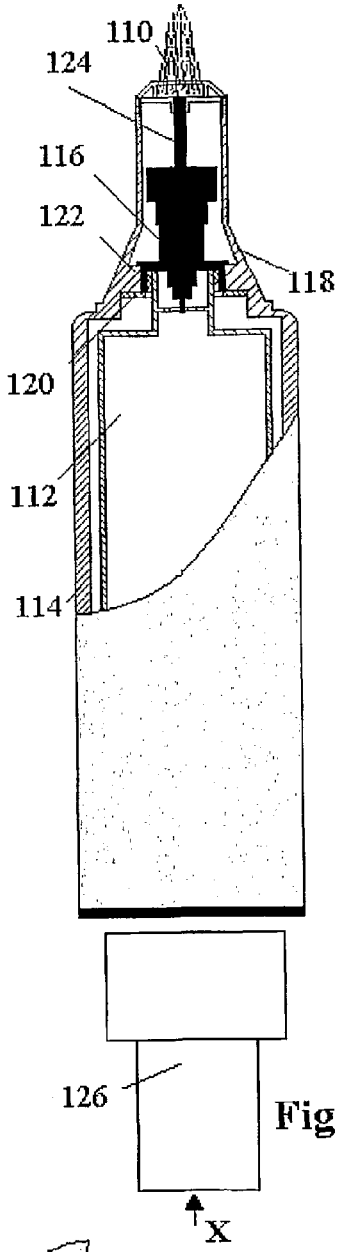
Fig 19
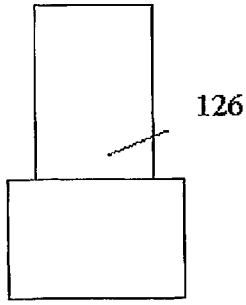
Fig 19a
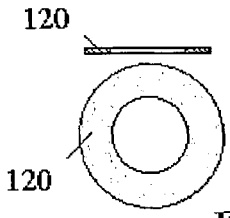
Fig 20a
Fig 20b
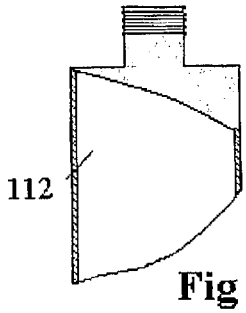
Fig 21
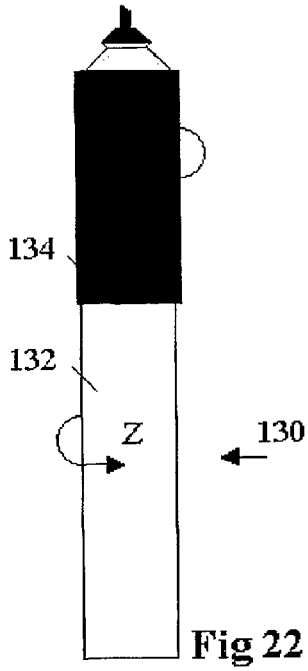
Fig 22
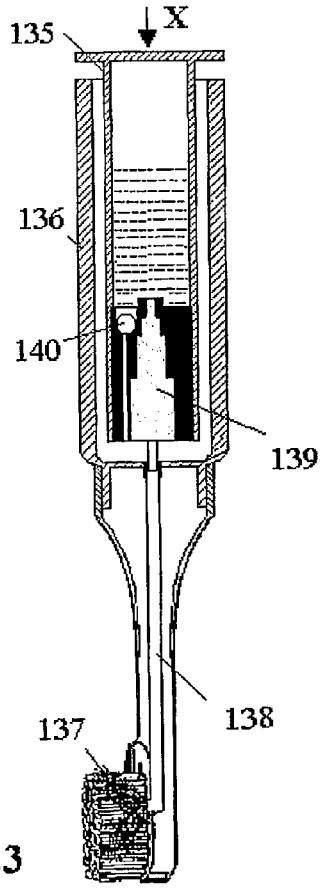
Fig 23
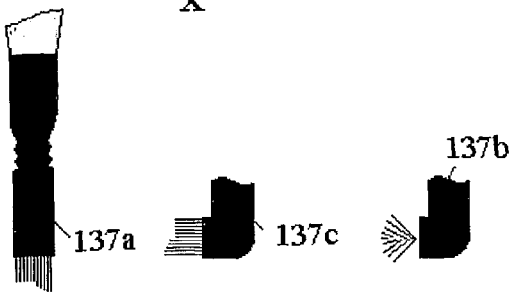
Fig 23a

FLUID APPLICATOR INSTRUMENT

Priority benefit under 35 U.S.C. § 119 is claimed to Great Britain Patent Application No. 0011689.7 filed May 15, 2000, Great Britain Patent Application No. 0023063.1 filed Sep. 20, 2000, Great Britain Patent Application No. 0030949.2 filed Dec. 19, 2000, and Patent Cooperation Treaty Application No. PCT/GB01/02031 filed May 9, 2001.

This invention relates to an instrument, and preferably a marking instrument, for applying a fluid to a surface and particularly, though not exclusively, to a writing pen, including a marker pen, or a brush, especially an artist's brush. Other types of brushes are contemplated, such as those for cleaning teeth or for applying mouthwash or perfume to the teeth.

Many different types of pens, drawing brushes, and markers for school or office use for various applications are known. Such instruments may include an absorbent felt in a casing that is loaded with the fluid, for example ink, and this finds its way to the tip of the instrument by gravity. Consequently, when the instrument is stored with the tip uppermost, the fluid drains away therefrom, and often such instruments are thrown away in the mistaken belief that all of the ink therein has been used up, whereas a vigorous shaking of the instrument would result in the fluid again finding its way to the tip. Other instruments have a replaceable cartridge, which again relies on gravity for its contents to find its way to the tip of the instrument. Drawing brushes for use by children, in particular, can be difficult to use.

It is an object of the present invention to provide an instrument for applying a fluid to a surface, such as a marking instrument, that overcomes, or at least alleviates, some problems associated with known fluid applicator instruments.

In accordance with one aspect of the present invention, there is provided an instrument for applying a fluid to a surface, preferably a marking instrument, comprising a fluid-applying tip, a holder for the tip, a cartridge containing a fluid to be applied, preferably a liquid, for example ink, paint, or a mouthwash, tooth perfume or cleaner, mounted within or connectable to the holder, and a manually-operable spray pump arrangement for repeatedly dispensing a predetermined amount of the fluid by manual pressure from the cartridge to the tip of the instrument.

Preferably the holder may comprise a casing for the cartridge and a housing for the tip, fitted together as a single unit or the holder can be a tip housing to which the cartridge can be connected. The instrument of the present invention, therefore, has an advantage of being provided with a cartridge that is replaceable or refillable, thereby avoiding the waste of disposing of the casing for the cartridge and the tip, together with any other components of the instrument, such as the housing for the tip, when the fluid therein has been used up.

The instrument of the present invention has the further advantage of being provided with a manually-operable spray pump arrangement, which can withdraw the fluid in the cartridge so as positively to direct it under pressure to the tip of the instrument without having to pressurise any container for the fluid. Furthermore, the spray pump is arranged to provide a predetermined amount of the fluid upon each operation, in dependence on the volume of the pump, thereby avoiding the possibility of continuous operation of the pump arrangement leading to exhaustion of the entire contents of the cartridge, and/or flooding of the fluid from the tip of the instrument.

The spray pump arrangement used in the instrument of the invention may be of any suitable design for repeatedly dispensing a predetermined, metered, quantity of fluid. Such pumps are well-known, for example, in dispensing perfume. Details of suitable pump arrangements are disclosed, by way of example only, in the following patent publications, the entire contents of which are included herein by reference: EP-0126175, U.S. Pat. Nos. 3,774,849, 4,029,261, GB-B 2252941, EP-A-0930102, and FR-A-2402388. Thus, in general, operation of the pump requires an initial stroke to expel air from the body thereof, so that subsequent release will draw fluid thereinto from a reservoir, which is un-pressurised. Subsequent operation will then dispense that fluid from the primed pump, via a delivery tube, as a spray, and subsequent release will then charge the pump with a fresh quantity of the fluid from the reservoir. Generally for production of a spray a spray nozzle is located at the exit of the delivery tube, but for the purpose of the present invention, such a spray nozzle is not usually needed.

Advantageously the instrument of the present invention will be of elongate configuration, and will typically be in the form of a pen or a marker, especially a whiteboard marker, or a brush, for writing or drawing. The fluid will usually be a liquid, and may be ink or paint, of any required colour. Perfumed or cleaning solutions or dispersions, including mouthwashes, can be used with a toothbrush of the present invention.

In a preferred embodiment, the pump arrangement is disposed longitudinally adjacent the tip of the instrument towards one end of the casing, and the cartridge extends away therefrom and is accessible at the other end of the casing such that manual pressure exerted longitudinally on the cartridge at that said other end is effective to operate the pump arrangement.

The pump arrangement or at least a component thereof, may be fixed longitudinally within the cartridge casing, with the cartridge longitudinally moveable therewithin. In a preferred configuration, the exit nozzle of the pump arrangement is fixedly secured within the casing, and the remaining components of the pump arrangement, including, for example, a pump body, inlet and outlet, move together with the cartridge as a single unit.

In another embodiment, the instrument, and in particular for example the cartridge casing, is arranged such that transverse inward manual pressure thereon moves the cartridge and the pump arrangement, or a component thereof, longitudinally relative to one another, thereby to effect said dispensing of the fluid. The inward pressure may be provided by a slideable member having a surface inclined to a longitudinal axis of the instrument for co-operation with a mating surface of the pump arrangement, thus to effect said relative longitudinal movement.

In a further embodiment, relative rotation of two portions of the instrument is effective to operate the pump arrangement. It will be appreciated, that such rotation may be translated into relative longitudinal movement between the pump arrangement and the cartridge.

It is also envisaged that the pump arrangement may be operated from the tip of the instrument, with manual pressure on the tip causing the requisite longitudinal movement thereof.

The instrument of the present invention may be provided with an intermediate chamber, which may have an external viewing window, between the cartridge and the tip so that a user may determine whether the next operation of the pump will result in fluid being dispensed to the tip, or otherwise effective to fill the intermediate chamber, with a subsequent operation of the pump arrangement being required to dispense the fluid from that chamber to the tip of the instrument.

Generally the tip itself has only a small fluid capacity and so is connected to a fluid reservoir in the tip housing such as a block of felt or foamed plastics material. The pump arrangement may include a spray nozzle located at the exit thereof to help to distribute the fluid being dispensed to this tip reservoir.

Manual pressure on the pump arrangement, directly or indirectly, will initially expel the air therefrom, and subsequent release is then effective to draw fluid into the pump. A subsequent operation of the pump arrangement then dispenses that predetermined, primed, amount of fluid from the pump, and continued pressure will not result in any more fluid being dispensed. When the liquid container is rigid air must replace the liquid which is dispensed. This replacement air is drawn in via a suitable opening in the spray pump, as in a conventional spray pump. A valve, such as a ball valve, can be used if needed to prevent fluid leakage via this air opening, when for example the instrument is inverted. Where the liquid container is not rigid, but very flexible, like a balloon, then it is not necessary for replacement air to be admitted and a valve is not needed.

In accordance with another aspect of the invention, there is provided an assembly for an instrument for applying fluid to a surface, preferably a marking instrument assembly, comprising a disposable or re-fillable cartridge containing a fluid to be applied and operatively associated therewith, preferably fixedly mounted thereon, a manually-operable spray pump arrangement for repeatedly dispensing a predetermined amount of the fluid under pressure from the cartridge.

In accordance with a further aspect of the invention, there is provided a disposable, or re-fillable, cartridge for the assembly and for the instrument of the present invention.

The present invention is particularly but not exclusively useful for dispensing relatively a small quantity, such as 0.001–5 millilitres or more of a fluid, for use particularly in a marking instrument.

Preferably the replaceable or refillable cartridge comprises a container suitable for use in the instrument of the present invention, the container comprising a primary reservoir for holding the fluid to be applied and having an outlet at one end, a fluid supply tube located within the primary reservoir, the supply tube being, in use, connected at one end to the outlet and having a secondary reservoir at its other end, wherein, when the container is in a first orientation, a measured dose of the marking fluid can enter the secondary reservoir, and wherein, when the container is inverted, the secondary reservoir will hold that dose of the fluid for dispensing, and the remaining fluid will be moved by gravity to another position within the container and retained.

When in the inverted position, the fluid which in the secondary reservoir can be delivered through the supply tube by using a manually-operable spray pump, a spring loaded valve mechanism or by squeezing the external container. Continued repeated pressure will then not result in any more fluid being dispensed.

For use with such a container refill the instrument can include an actuator for the spray pump arrangement of the refill and a capillary tube which enters inside the tip reservoir of the instrument as a single unit, fixed tightly to the instrument.

The fluid is preferably of relatively low viscosity and does not include any large particulates so the ejection of the fluid from the spray pump arrangements does not require undue manual pressure and the delivery tube exit is not easily blocked. The refill cartridge, before use, is covered over its opening by a diaphragm which is connected to the supply tube, that can be pierced by a sharpened point on the actuator to allow passage of only the fluid, which is held in the secondary reservoir.

Several embodiments of the fluid applicator instrument, instrument assembly, replaceable cartridge and refillable container each in accordance with the present invention, will now be described, by way of example, with reference to the accompanying drawings, in which.

Figure 3:
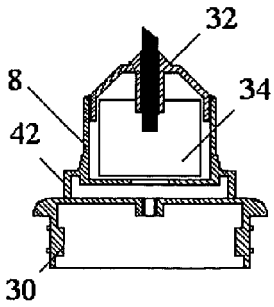
FIG. 3 is a further section through the pen of FIG. 1 showing the tip and pumphousing.
Figure 4A:
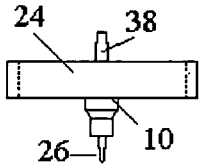
Figure 4B:
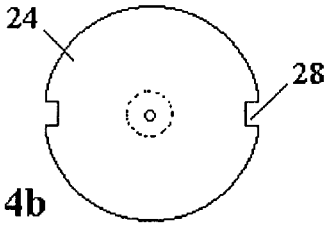
Figure 4C:
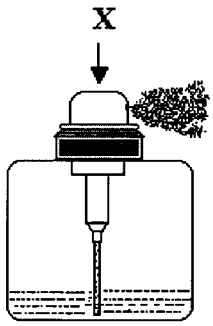
Figure 1:
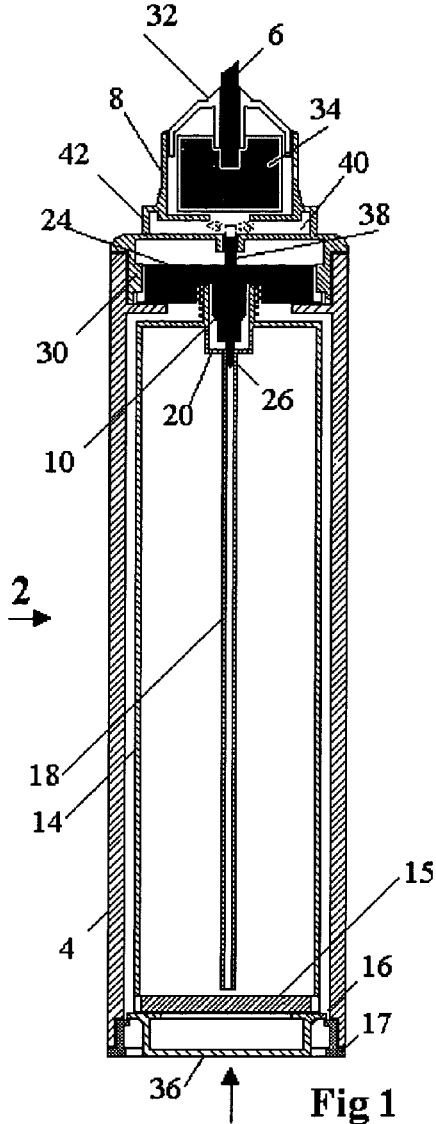
FIG. 1 is a section through a first embodiment of a marker pen.

FIGS. 4*a* and 4*b* are an elevation and plan respectively of the pump arrangement of the pen of FIG. 1;

FIG. 4*c* is an elevation of an example of a conventional manual spray pump arrangement that can be used in the instrument of FIG. 1;

FIG. 5 is a section of the casing of the instrument of FIG. 1;

FIG. 6 is a section of the fluid cartridge of the instrument of FIG. 1;

FIGS. 7*a* and 7*b* are a section and plan respectively of the inner cap for the casing of FIG. 5;

FIGS. 8*a* and 8*b* are a section and plan respectively of the retaining ring for the cap of FIGS. 7*a* and 7*b;*

Figure 9:
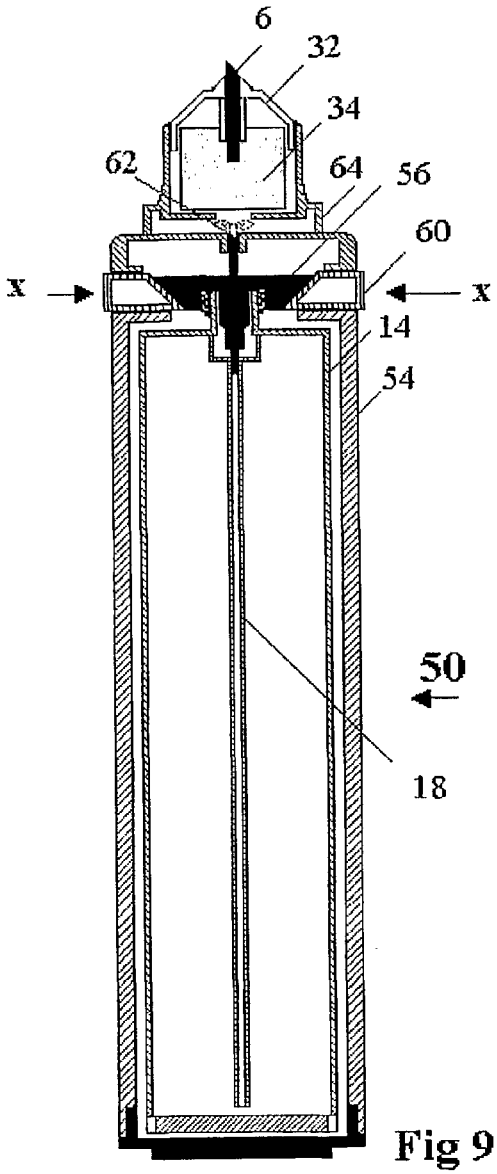
Figure 10:
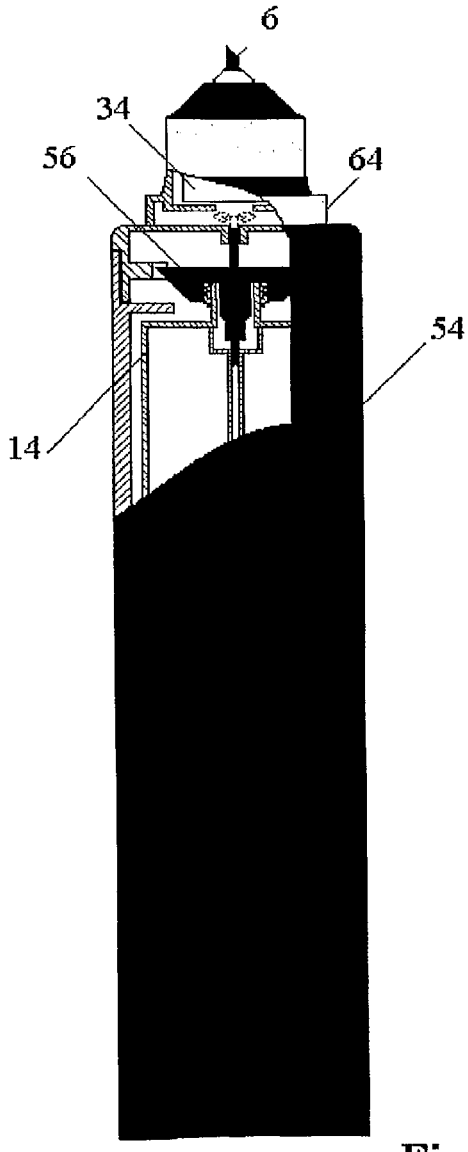
Figure 16:
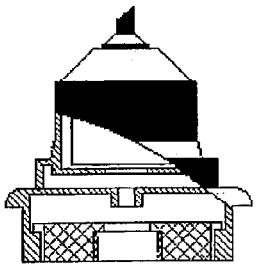
Figure 17A:
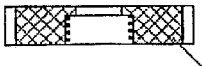
Figure 17B:
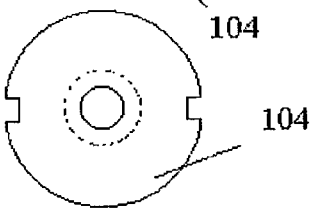
Figure 18:
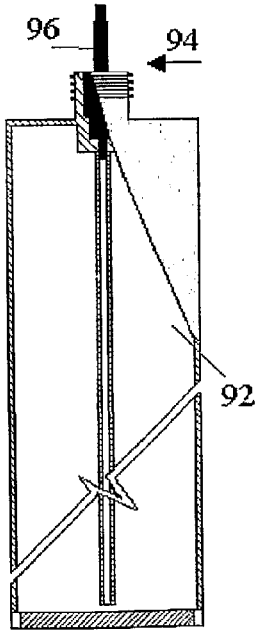
Figure 15:
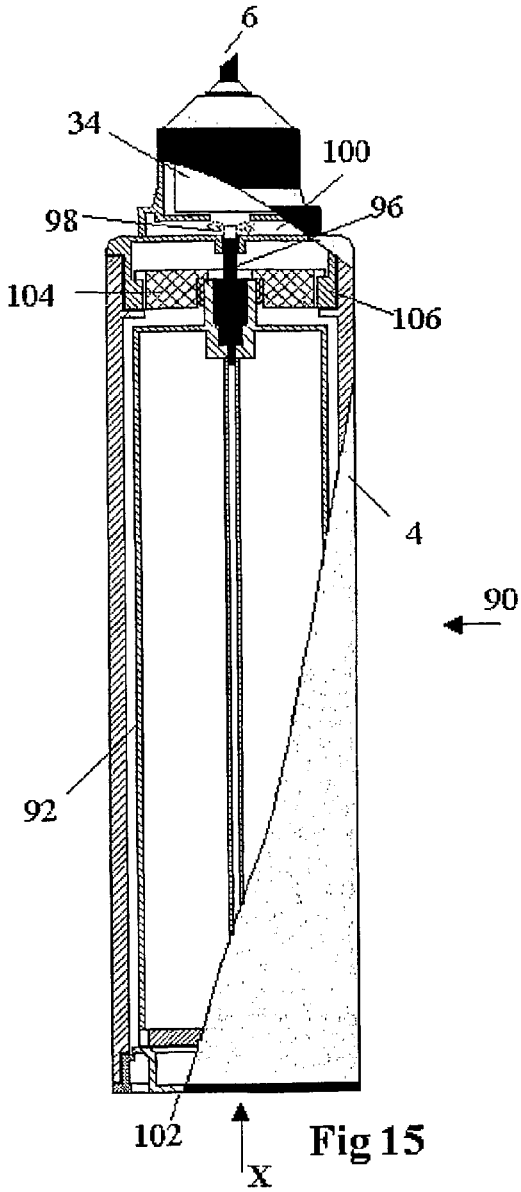
Figure 15A:
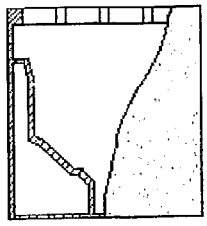
Figure 24:
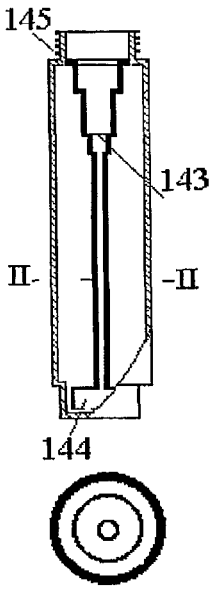
Figure 25:
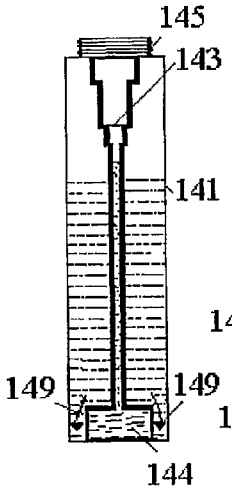
Figure 25A:
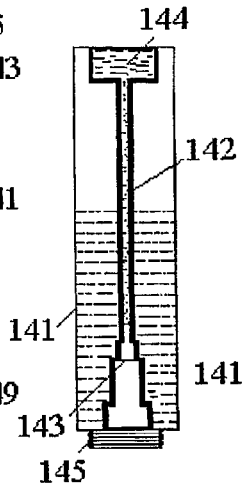
Figure 25B:
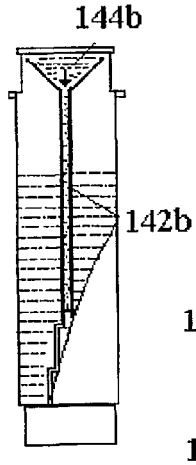
Figure 25C:
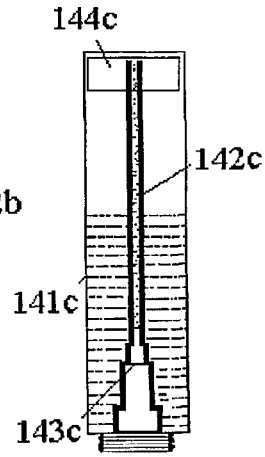
Figure 26:
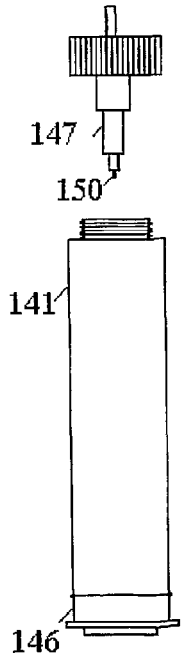
Figure 27:
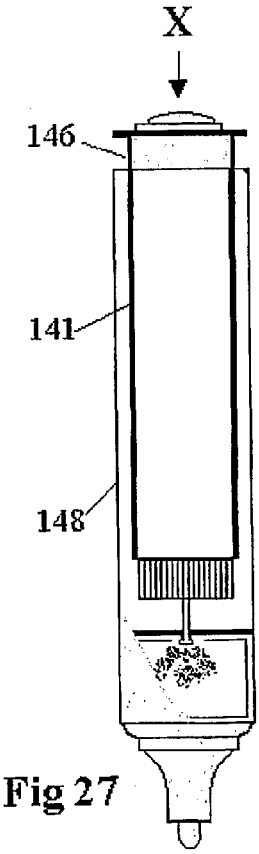
Figure 28:
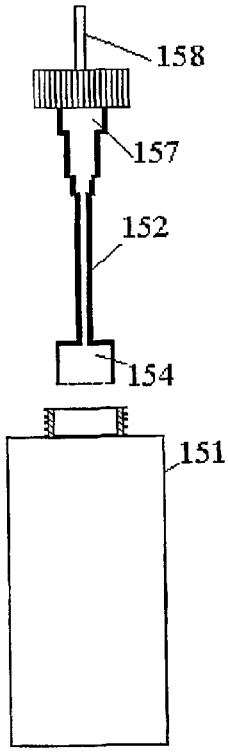
Figure 29:
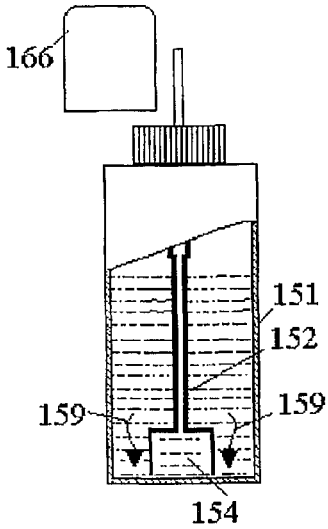
Figure 29A:
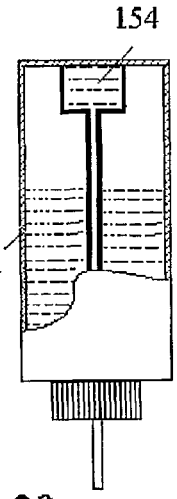
Figure 30:
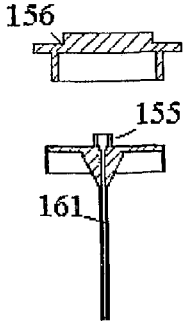
Figure 31:
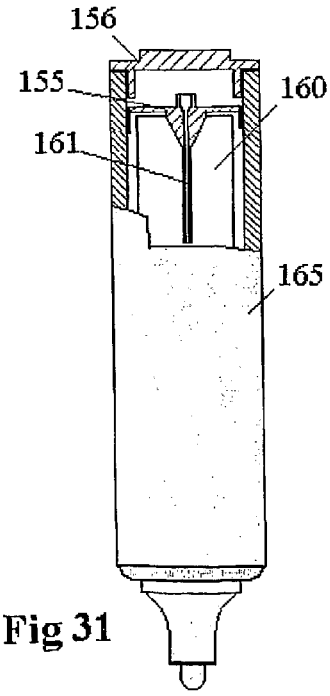
Figure 32:
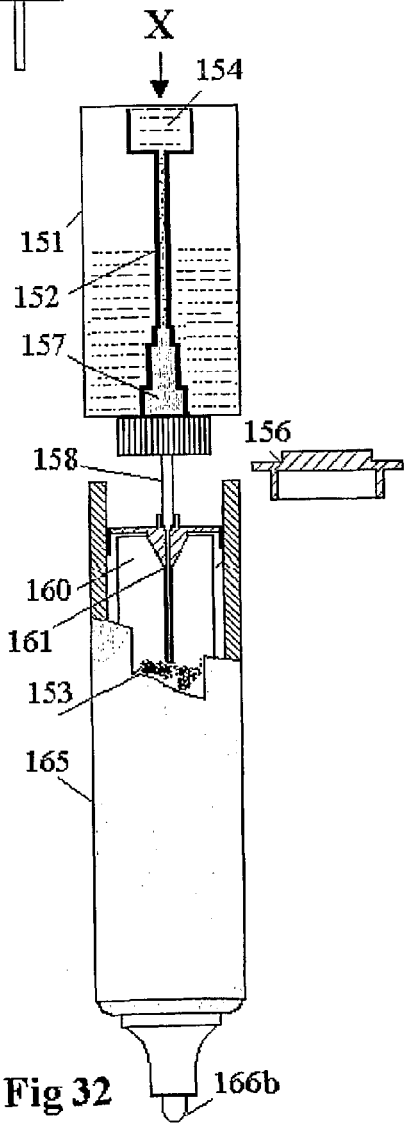
Figure 33:
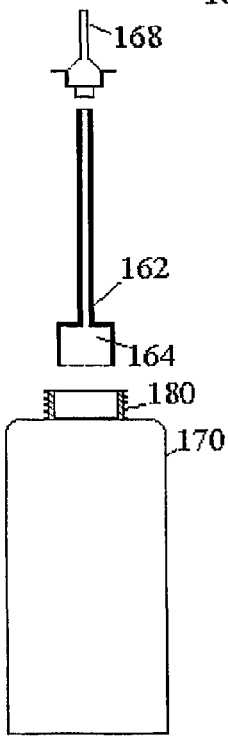
Figure 34:
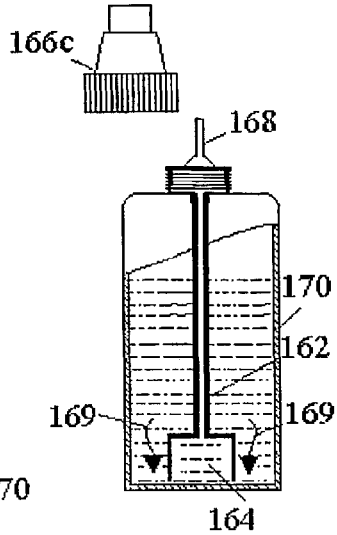
Figure 34A:
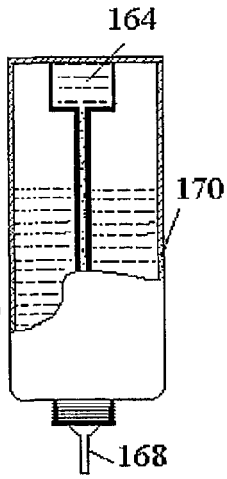
Figure 36:
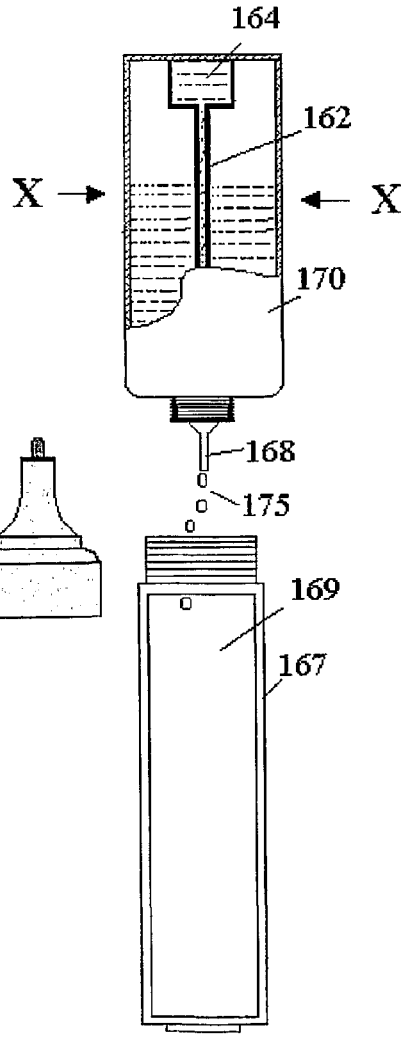
Figure 35:
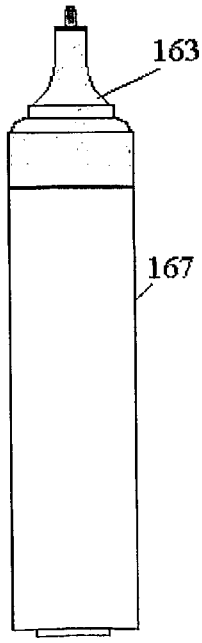
Figure 37:
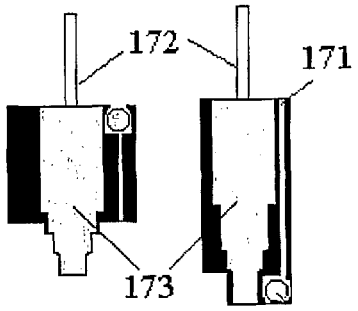
Figure 38:
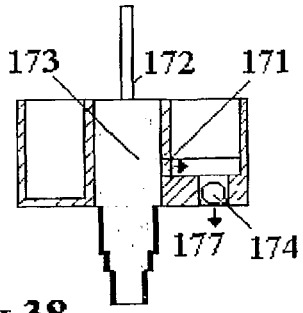
Figure 39:
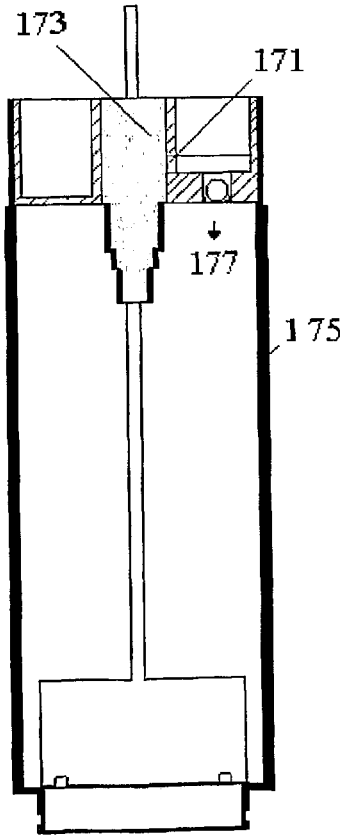
Figure 40:
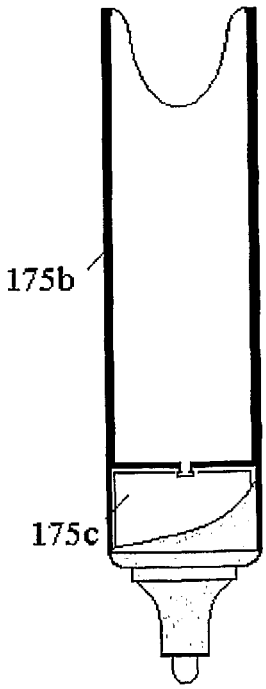
Figure 40:
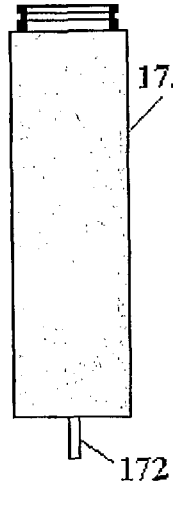
Figure 40B:
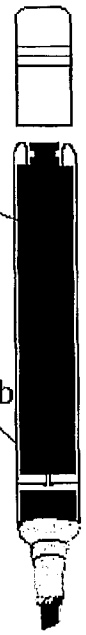
Figure 41:
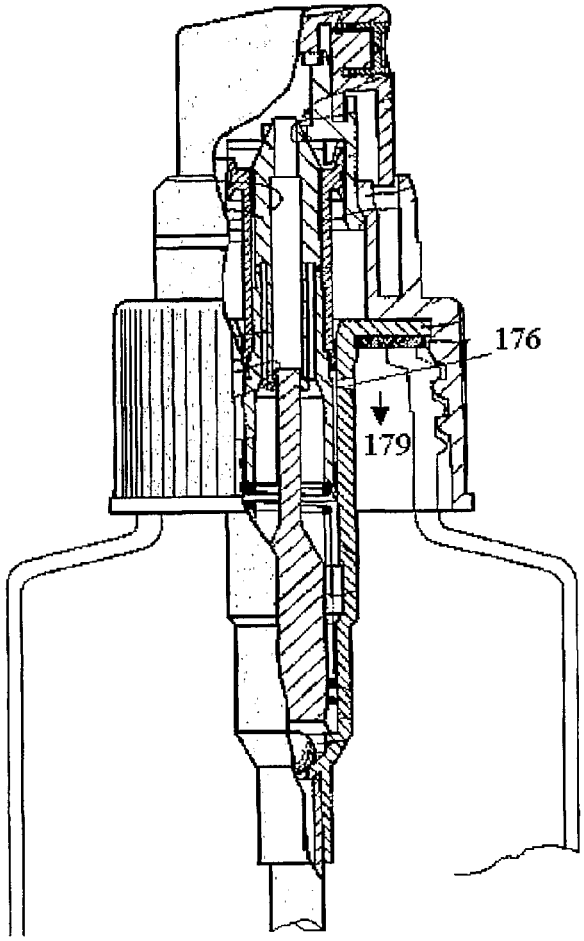
Figure 42:
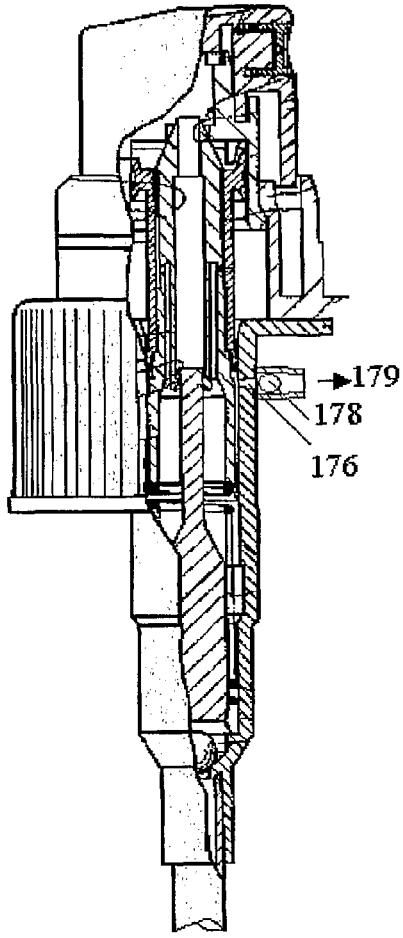

FIG. 9 is a section through a second embodiment of a marking pen, with the pump arrangement in the closed position;

FIG. 10 is partial section of the marking instrument of FIG. 9 rotated through 90° about its longitudinal axis, and showing the pump arrangement in the open position;

FIG. 11 is a sectional elevation of a third embodiment of a marking pen, showing the pump arrangement in the closed position;

FIG. 12 is a partial section of the instrument of FIG. 11, rotated though 90° about its longitudinal axis;

FIGS. 13 and 13*a* are a section and elevation, rotated respectively through 90°, of the tip and pump arrangement of the instrument of FIGS. 11 and 12;

FIGS. 14 and 14*a* are external elevations of the tip casing of the instrument of FIGS. 11 and 12; FIG. 14*a* including the felt block of the tip of the instrument;

FIG. 15 is a view of a fourth embodiment of a marking pen in partial section;

FIG. 15*a* shows in partial section the cap for the pen of FIG. 15 in a position to act as a pusher button for the pen;

FIG. 16 shows in partial section the tip and pump housing of the pen of FIG. 15;

FIGS. 17*a* and 17*b* are a section and plan respectively of the retaining member for the pump arrangement of the pen of FIGS. 15 and 16;

FIG. 18 is a partial elevation of an integral assembly of the cartridge and pump arrangement of FIG. 15;

FIG. 19 is a partial sectional elevation of a fifth embodiment of the writing instrument, in the form of a brush, with its cap being shown in a position to act as a pusher button for the brush;

FIG. 19*a* shows the cap for the brush of FIG. 19;

FIGS. 20*a* and 20*b* show a section and elevation respectively of the pump arrangement retaining member of the brush of FIG. 19;

FIG. 21 shows a partial sectional elevation of the cartridge for the brush of FIG. 19;

FIG. 22 shows in elevation a sixth embodiment of a marking instrument;

FIG. 23 shows a partial sectional elevation of the instrument, in the form of a toothbrush;

FIG. 23*a* shows in elevation different end fittings for the toothbrush of FIG. 23;

FIG. 24 shows a section of a replaceable cartridge refill of the present invention with a secondary reservoir and also shows below a cross section on the line II—II;

FIG. 25 shows the replaceable cartridge refill of FIG. 24 in use in its normal position with the fluid entering the secondary reservoir;

FIG. 25*a* shows rotated by 180° the replaceable cartridge refill of FIG. 24 in use in its inverted position with the secondary reservoir holding a quantity of the ink;

FIG. 25*b* shows in partial section a second embodiment of the replaceable cartridge and the internal secondary reservoir of FIG. 24;

FIG. 25*c* shows in section a third embodiment of the cartridge of FIG. 24 in its inverted position with a small piece of an absorption material such as sponge or felt acting as a secondary reservoir;

FIG. 26 shows an elevation of the replaceable cartridge of FIGS. 24 to 25*c* with a manually-operable spray pump arrangement;

FIG. 27 shows in section the replaceable cartridge of FIG. 26 inserted inside a marker pen of the present invention;

FIG. 28 shows an exploded elevation of a dispensing container and manually operable spray pump arrangement for use as a refill for the instrument of the present invention;

FIG. 29 shows a partial sectional view of the dispensing container of FIG. 28 in its normal position with fluid entering the secondary reservoir;

FIG. 29*a* shows a partial section view of the dispensing container of FIG. 29 in its inverted position;

FIG. 30 shows in section the end cap and the actuator with an integral capillary tube, which is a part of the marker pen of FIG. 31;

FIG. 31 shows a partial sectional view of a refillable marker pen;

FIG. 32 shows a partial sectional view of the dispensing container of FIG. 29 when refilling the marker pen of FIG. 31;

FIG. 33 shows a sectional view of the secondary reservoir with a supply tube and the nozzle of an instrument of the present invention with a bottle of a supply of the fluid to be used;

FIG. 34 shows in section the combination of FIG. 33 with the secondary reservoir and nozzle fixed tightly to the bottle in its normal position, and also in elevation a cap for the bottle;

FIG. 34*a* shows in partial section the combination of FIG. 34 in its inverted position with fluid retained in the secondary reservoir;

FIG. 35 shows in elevation a complete marker pen of the refillable type;

FIG. 36 shows in partial section how the pen of FIG. 35 is refilled using the bottle combination of FIG. 34;

FIG. 37 shows in section a spray pump arrangement with a check valve for use with the instrument of FIGS. 1, 9, 11, 15, 19 and 23;

FIG. 38 shows in section the spray pump arrangement of FIG. 37 with an alternative check valve;

FIG. 39 shows in section the spray pump arrangement of FIG. 38 fitted tightly into a cartridge refill;

FIG. 40 shows in partial section the holder of a marker pen with the cartridge refill of FIG. 39;

FIG. 40*b* is an elevation of the complete marker pen of FIG. 40;

FIG. 41 shows in partial section a known spray pump with a single air opening; and FIG. 42 shows in partial section the known spray pump of FIG. 41 but modified for use in the pump arrangement of the present invention.

There are now described twelve examples of embodiments of the present invention, in which the arrow "X" shows the direction of the manual pressure to be applied to the instrument.

EXAMPLE 1

Referring to FIGS. 1 to 8*b*, a pen 2 comprises an elongate cylindrical casing 4, a writing tip 6, and a housing 8 that contains a spray pump 10. The tip 6 and housing 8 are contained within a closure cap 12 that is mounted thereon to abut the casing 4. A replaceable ink cartridge 14 is mounted within the casing 4, and secured in place by a mounting member 16 at the end remote from the tip 6, as a safety feature. The mounting member 16 (see details in FIGS. 7*a* and 7*b*) is retained within the end of the cartridge 14 by means of an annular screw-threaded retaining ring 17 (see details in FIGS. 8*a* and 8*b*). A capillary tube 18 has an open end adjacent the cartridge mounting member 16 and extends towards a diaphragm 20 that closes the other, inner end of the tube 18 adjacent the pump 10.

Fluid communication between the contents of the cartridge 14 and the pump 10 is achieved by introducing the cartridge 14 into the casing 4 and making a screw threaded connection onto the body 24 of the pump 10, which causes a sharpened tip 26 of the pump 10 to pierce the diaphragm 20. The pump body 24 has a pair of notches 28 in its rim, by which it is introduced into the housing 8 and retained therein against rotational movement by housing projections 30, whilst being allowed to move longitudinally within the housing 8. The cartridge 14 is provided on its base with a plurality of notches 15 to facilitate rotation during attachment.

The pen tip 6 which can be made from felt, is mounted in a tip housing 32 that is fitted onto the pump housing 8, and that contains a cylindrical block of felt 34 to act as a reservoir for marking ink for the tip. A spray nozzle 38 of the pump 10 is secured against longitudinal movement by being sealed into the base wall of a chamber 40, into which it projects.

The spray pump is of the type used in a conventional manual sprayer such as is illustrated in FIG. 4*c*, the nozzle cap of which is pushed manually in the direction of arrow X to cause a spray to be ejected laterally. When used in the pen of FIG. 1 the conventional nozzle cap is not used.

In operation, the external surface 36 of the cartridge closure member 16, acting as a pusher button, can be depressed by a thumb or finger of the user of the pen 2 in the direction of arrow X, this being effective to move the ink cartridge 14 longitudinally within the casing 4 together with the pump body 24, relative to the nozzle 38. This movement expels air from within the pump 10 so that upon release of the plunger 36, ink from within the cartridge 14 is sucked up into the pump body 24 through the capillary tube 18. Subsequent depression of the plunger 36 is then effective to dispense the ink from the pump body 24 and to cause it to be ejected as a spray from the fixed pump nozzle 38, into the chamber 40. The predetermined amount of ink thus displaced from the cartridge 14 enters the chamber 40 within the pump housing 8, and is also absorbed by the block of felt 34, in which the pen tip 6 is embedded. It will be appreciated that maintaining the plunger 36 depressed does not dispense any more ink from the cartridge 14, a release and further depression of the plunger 36 being required to do this. It will also be appreciated, that an initial usage of the pen 2 may require several operations of the plunger 36 so as completely to fill the chamber 40 and to load the felt 34 so that the tip 6 is supplied with sufficient ink for writing. The chamber 40 has a window 42 in a side wall thereof, so that the user can see whether there is ink contained therewithin.

Replacement air is allowed back into the pump body 24 through a check valve in the body of the pump as shown in greater detail in FIGS. 37 and 38.

Figure 2:
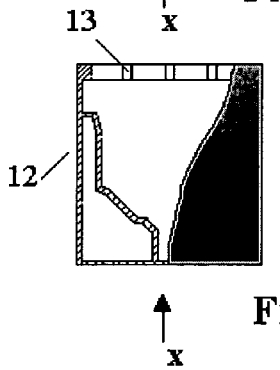
FIG. 2 is a partial section though the cap of the pen of FIG. 1, the cap being shown in a position to act as a pusher button for the pen.

During use of the pen, the closure cap 12 can be mounted on the casing 4 so as to fit into the annular groove between the mounting member 16 and the retaining ring 17, so as to cover the pump plunger 36 and thereby to prevent accidental dispensing on ink from the cartridge 14. The cap 12 is notched at 13 for engagement with the cartridge 14 to screw the cartridge at its inner end onto the pump 10 and is shaped internally to fit over the tip 6 and its housing 32. As shown in FIGS. 1 and 2, the cap 12 can be reversed and used as a pusher button by engagement with the plunger 36 of the cartridge 14.

EXAMPLE 2

Referring to FIGS. 9 and 10, the writing pen 50 has a cartridge 14 mounted within a cylindrical casing 54. As in the embodiment of FIG. 1, the inner end of the cartridge 14 is secured to a pump body 56 by means of a screw threaded engagement, forming a fluid communicating path therethrough. The pump body 56 is of generally frustoconical shape, with the larger transverse surface directed towards the tip 6 of the pen 50. A pair of radially inwardly directed spring loaded plungers 60 are mounted in the side wall of the pen casing 54 and have inner surfaces shaped to mate with the frustoconical surface of the pump body 56. A nozzle 62 of the pump arrangement is, as before, securely retained within a transverse wall of the pump housing 64.

In operation of the pen 50, inward pressure in the direction of the arrows X on the plungers 60 is effective for the frustoconical mating surfaces to slide over one another, so as to urge the pump body 56, carrying the cartridge 14, up towards the fixed nozzle 62. These results, after the air has initially been expelled, in drawing in the ink contained within the cartridge 14, and causing it to be dispensed and to spray out through the nozzle 62 within the pump housing 64. As before, the ink is also directed onto the cylindrical block of felt 34 located within the tip housing 32, and therefrom to the pen tip 6.

EXAMPLE 3

The pen 70 of FIGS. 11 and 12 operates on the same principle as the pen 50 of FIGS. 9 and 10, but in this embodiment, the frusto-conical body 72 of the pump arrangement is inverted such that its diameter decreases in the direction towards the pen tip 6. Consequently, the corresponding mating sliding surfaces of a pair of plungers 74 mounted on the pen casing 76 extend progressively outwardly in the direction away from the pen tip 6. Also as shown in this embodiment, the dispensing channel 78 that extends through the pump body 74 is in direct communication with the block of felt 80. Thus, in the pen 70 there is not provided any intermediate chamber between the ink being dispensed from the cartridge 14 and being absorbed by the block of felt 80, and there is no provision for a spray head as the outlet of the pump arrangement.

FIGS. 13 and 13*a* show detail of the mounting 82 for the tip 6, the felt housing 84 formed together with the moveable part 72 of the pump, and the cartridge-engaging portion 86 of the pump arrangement.

In the embodiments heretofore described, it is envisaged that the pump arrangement of the pen will be permanently secured to the pen casing, and that the only replaceable component will be the cartridge, which can be replaced with a full one when empty, or refilled.

EXAMPLE 4

The embodiment of FIGS. 15, 15*a*, 16, 17*a*, 17*b*, and 18 disclose a pen 90 comprising a casing 4 and tip 6 as before, but in which a cartridge 92 is formed integrally with components of the pump arrangement 94 from which a spring loaded nozzle 96 projects. As can be seen in FIGS. 15 and 16, the tip of the nozzle 96 engages with a spray head 98 and is fixedly mounted on a transverse wall of an intermediate spray chamber 100 that leads to the felt block 34.

Thus, manual pressure exerted on the based 102 of the cartridge 92 urges the cartridge and the pump arrangement 94 upwardly, thus dispensing the predetermined amount of liquid into the chamber 100 and onto the felt 34. This longitudinal movement is guided by the slotted pump body 104 moving along inward projections 106 of the housing 4 whilst being restrained against rotational movement.

EXAMPLE 5

FIGS. 19 to 21 show a writing instrument in the form of a brush having a tip 110 that is supplied by paint from the interior of a cartridge 112 mounted within a casing 114. A pump arrangement 116 is located within a pump housing 118 by means of a circular washer 120 that bears against an inwardly-directed projection 122 of the pump housing 118. In this embodiment, the dispensing channel 124 of the pump arrangement 116 terminates directly in contact with the brush 110. When not in use, the tip 110 of the brush is protected within a closure cap 126. The longitudinal movement of the cartridge 112 is effected by pressure on the base thereof in the direction of the arrow X (FIG. 19). It will also be seen that in this embodiment, the cartridge 112 is not provided with the optional inner capillary tube of the previous embodiments.

EXAMPLE 6

The pen 130 of FIG. 22 is formed with a casing in two parts, 132 and 134 extending longitudinally axially thereof. The casing portions 132 and 134 are rotatable relative to each other about the longitudinal axis of the pen 130, as shown by the arrows Y and Z. The relative rotation is arranged to operate a pump arrangement (not shown) of the pen 130 so as to dispense a predetermined amount of ink from a replaceable cartridge (not shown) secured therewithin, to the pen tip 6.

EXAMPLE 7

FIG. 23 shows a toothbrush having a hollow handle 136 and a brush head 137. Within the handle 136 is a liquid tooth cleaner, mouthwash or perfume containing cartridge 135 attached to a manually operable spray pump arrangement 139 of the type previously described. The exit of the pump is connected to the base of the brush head 137 by a duct 138 so as to convey the liquid to the brush head as required. A check valve 140 is incorporated into the body of the spray pump to prevent leakage of liquid when the brush is in operation. Variations of the conventional brush head 137 are shown in FIG. 23*a* for the end of the toothbrush that is applied to the teeth. A straight brush head in line with the axis of the handle 136 is shown in the first variation of FIG. 23*a*, whilst a right angled nozzle and brush head are shown in the second and third variations 137*b* and 137*c*, respectively. The ends can be interchangeable.

EXAMPLE 8

Referring to FIGS. 24 to 27, the replaceable ink cartridge refill 141 of FIG. 24 is shown with a screw thread for attachment 145, a secondary reservoir 144 and a diaphragm 143 preventing ink leakage before use.

According to FIG. 26 when inside the replaceable ink cartridge refill 141, and closed with a manually operable spray pump, the sharpened tip 150 of the pump 147 is caused to pierce the diaphragm 143 and allow release of the ink. According to FIG. 25 when the cartridge in the normal positions the marking fluid can enter the internal secondary reservoir 144 through small holes 149 and a small quantity of the ink held therewithin.

As shown in FIG. 25*a* when the cartridge refill is inverted the secondary reservoir will retain this small quantity of marking fluid and the other marking fluid fall by gravity to the other end of the cartridge 141 where it is retained. This small quantity of ink can then be dispensed.

As shown in FIG. 27 when the replaceable cartridge is inside the marker pen, by pressing in the direction X a subsequent operation of the pump arrangement then dispenses that predetermined, primed, amount of fluid, which in the small secondary reservoir 144. Continued repeated pressure will not result in any more fluid being dispensed.

EXAMPLE 9

This is the same as Example 24, but as shown in FIG. 25*c* the replaceable cartridge comprising a small piece of the felt or sponge 144*c* in place of the secondary reservoir. The sponge acts as a secondary reservoir by absorbing some of the fluid ink when the cartridge in the normal position as in FIG. 26. When the cartridge is rotate 180-degree the sponge will retain some of the marking fluid and the other marking fluid will fall by gravity to the other end of the cartridge as shown in FIG. 25*c*. A subsequent operation of the pump arrangement then dispenses that predetermined, small amount of fluid, which already in the sponge.

EXAMPLE 10

Referring to FIGS. 28 to 32, the marker pen comprising an actuator 155, capillary tube 161, tail plug 156, felt 160, tip 166*b* and the body 165.

After the tail plug 156 is removed from the marker pen, and the user inserts the nozzle (upper stem of the spray pump) 158 into the actuator 155, which is a part of the pen 165. For refilling, the base of the dispensing container 151 is depressed by a thumb or finger of the user of the pen 165, this being effective to move the dispensing container longitudinally with the pump body 157, relative to the nozzle 158. This movement in the direction X expels air from within the pump 157 so upon release of the container 151, ink from within the secondary reservoir 154 is sucked up into the pump 157 through the capillary tube 152. Subsequent depression of the base of the container 151 is then effective to dispense the ink from the pump 157 to cause it to be ejected as a spray 153 from the pump nozzle 158, into the felt 160 through the capillary tube 161, which is a part of the actuator. The length of the capillary tube 161 is approximately one third of the long of the felt or more, in order to be easy and quickly to distribute the fluid ink through the felt. It is also appreciate that it may require several depressions of the base of the container 151 so as completely to empty the reservoir 154 and to load the felt 160. Then the tail plug 156 is closed.

EXAMPLE 11

Referring to FIGS. 33 to 36, the plastic bottle 170 with a screw-threaded neck 180 for a closure cap 166*c*, and comprises a secondary reservoir 164 for holding a marking fluid, with a supply tube 162 and the nozzle 168. According to FIG. 34 the bottle 170 in the normal position full by fluid ink, the secondary reservoir 164 with a supply tube 162 and the nozzle 168, all together are fixed tightly to the bottle 170. In this position the ink will enter the reservoir 164 through the holes 169.

According to FIG. 34*a* when the container 170 inverted, the reservoir 164 holding a quantity of the ink, which we need to refill the pen, and the other liquid will go to another direction, relies on gravity. Subsequent according to FIG. 36, the plastic bottle 170 is squeezed, as indicated by arrow X to delivered only the ink which in the secondary reservoir 164 through the supply tube 162 as drops 175 to the felt 169 of the pen 167.

EXAMPLE 12

Referring to FIGS. 37 to 42, four variations of conventional spray pump arrangements are shown. In the first and second variations in FIG. 37 two examples of the check valves 171 are shown. In each example the pump is provided with a small longitudinal check valve 171 in its wall so that air can be expelled from the body 173 of the pump when manual pressure is applied and the liquid is ejected from the pump body 173 through tube 172.

When a conventional pump such as shown in FIG. 41 is inverted, however, liquid can leak out of the air hole 176. In the third variation shown in FIG. 38 a small ball valve 174 is provided in a right angled duct 177 leading away from the convection air hole 171 to close the passageway when the cartridge is inverted and prevent liquid leakage.

When suction is applied the ball 174 retreats and the passageway is opened for liquid to be sucked in and to release air to the inside of the cartridge.

FIG. 39 shows the pump arrangement of FIG. 38 fixed tightly in position on the top of the cartridge 175. This cartridge of FIG. 39 when inverted fits into the holder 175*b* of the marker pen with its tip as in the manner of FIGS. 26 and 27. Nozzle 172 of the pump 173 ejects into the felt 175*c* of the pen marker fluid when the pump is operated.

The complete pen is shown in FIG. 40*b* in which the cap of the pen is turned round and used as a pusher button for the cartridge 175 to operate the pump. FIGS. 41 and 42 show the spray pumps of EP-A-0126175 but in FIG. 42 the pump has been modified for use in the present invention.

As shown in FIG. 42 the air hole 176 has been modified to include a ball valve 178 of the type shown in FIG. 38. In both cases air is pushed out through hole 176 in the direction 179 when manual pressure is applied. When the spray pump is inverted the ball valve checks leakage of ink out of the pump.

It will be appreciated, that the cartridge may be substantially the same for each of the embodiments described. It is to be understood that various features of the present invention, which are, for clarity or convenience, described in the context of separate embodiments, may also be provided in any combination in a single embodiment. Conversely, various features of the present invention which are, for brevity or otherwise, described in the context of a single embodiment, may also be provided separately or in any suitable combination.

What is claimed is:

1. An instrument for applying a fluid to a surface comprising a fluid-applying tip, a holder for the tip, a cartridge containing a fluid to be applied mounted within or connectable to the holder, and a manually-operable spray pump arrangement for repeatedly dispensing a predetermined amount of the fluid under pressure, said pressure being solely obtained by manual force from the cartridge to the tip of the instrument, and wherein the holder comprises a casing for the cartridge and a housing for the tip fitted together for a single unit.

2. An instrument according to claim 1 wherein the holder is a tip housing to which the cartridge can be connected.

3. An instrument according to claim 1, wherein the pump arrangement and the cartridge are assembled into a single unit.

4. An instrument according to claim 1, in the form of a marking pen.

5. A marking instrument according to claim 4, wherein the tip of the pen comprises a quantity of material, preferably felt, for absorbing marking fluid dispensed from the cartridge.

6. An instrument according to claim 1, wherein the tip thereof comprises a brush.

7. An instrument according to claim 6 in the form of a toothbrush.

8. An Instrument according to claim 1 wherein; a replaceable cartridge for use in an implement for applying a fluid to a surface, the cartridge comprising: a primary reservoir for holding a fluid to be applied and having an outlet at one end; a fluid supply tube located, in use, within the primary reservoir, the supply tube being, in use, connected at one end to the outlet and having a secondary reservoir at its other end; wherein when the cartridge is in a first orientation, a measured dose of the fluid can enter the secondary reservoir, and wherein, when in a second, inverted orientation, no more than the measured dose within the secondary reservoir can be delivered through the supply tube.

9. A cartridge according to claim 8, wherein the secondary reservoir is formed from an absorbent material such as felt or sponge.

10. A cartridge according to claim 8, wherein a manually operable spray pump is attached to the one end of the supply tube for dispensing the measured close of the fluid.

11. A cartridge according to claim 8 wherein valve means are connected to the one end of the supply tube for dispensing the measured dose of the fluid.

12. A cartridge according to claim 8, wherein a nozzle is connected to the end of the supply tube.

13. A cartridge according claim 8, wherein some or all of the measured dose is supplied by squeezing the primary reservoir.

14. A marking instrument comprising: a marking fluid dispensing means for marking a surface; and a cartridge according to claim 8.

15. A marking instrument according to claim 14, further comprising an actuator for insertion into marking fluid-containing means within the marker.

16. A marking instrument according to claim 15, wherein the actuator comprises means for engagement with the outlet from the main reservoir and injection means for injecting the marking fluid into the marker.

17. A marking instrument according to claim 16, wherein the injection means is a tube.

18. A marking instrument according to claim 14, wherein the cartridge is replaceable or refillable.

19. An instrument according to claim 1 wherein; a refillable container for use in refilling an Implement for applying a fluid to a surface, the container comprising; a primary reservoir for holding a fluid to be applied and having an outlet at one end; a fluid supply tube located, in use, within the primary reservoir, the supply tube being, in use, connected at one end to the outlet and having a secondary reservoir at its other end; wherein, when the container is in a first orientation, a measured dose of the fluid can enter the secondary reservoir, and wherein, when in a second, iverted orientation, no more than the measured dose within the secondary reservoir can be delivered through the supply tube.

20. A container according to claim 19, wherein the supply tube is connected, in use, to an actuator within the instrument for dispensing the fluid into a fluid reservoir connected to the tip of the instrument.

21. A container according to claim 19, wherein the secondary reservoir is formed from an absorbent material such as felt or sponge.

22. A container according to claim 19, wherein a manually operable spray pump is attached to the one end of the supply tube for dispensing the measured dose of the fluid.

23. A container according claim 19 wherein valve means are connected to the one end of the supply tube for dispensing the measured dose of the fluid.

24. A container according to claim 19, wherein a nozzle is connected to the end of the supply tube.

25. A container according to claim 19, wherein some or all of the measured dose is supplied by squeezing the primary reservoir.

26. A marking instrument comprising: a marking fluid dispensing means for marking a surface; and a container according to claim 19.

27. A marking instrument according to claim 26, further comprising an actuator for insertion into marking fluid-containing means within the marker.

28. A marking instrument according to claim 27, wherein the actuator comprises means for engagement with the outlet from the main reservoir and injection means for injecting the marking fluid into the marker.

29. A marking instrument according to claim 28, wherein the injection means is a tube.

30. A marking instrument according to claim 26, wherein the container is replaceable or refillable.

* * * * *